United States Patent [19]

Muir

[11] Patent Number: 4,977,758

[45] Date of Patent: Dec. 18, 1990

[54] KNITTING MACHINES

[75] Inventor: Terence R. M. Muir, Nottingham, England

[73] Assignee: Smith & Nephew Textiles Limited, England

[21] Appl. No.: 450,592

[22] Filed: Dec. 13, 1989

Related U.S. Application Data

[63] Continuation-in-part of Ser. No. 94,338, Sep. 8, 1987, abandoned.

[51] Int. Cl.[5] ..... D04B 9/06; D04B 15/50; D04B 15/88

[52] U.S. Cl. ..... 66/27; 66/125 R; 66/132 R; 66/151

[58] Field of Search ..... 66/27, 54, 125 R, 132 R, 66/132 T, 151

[56] References Cited

U.S. PATENT DOCUMENTS

| | | | |
|---|---|---|---|
| 431,417 | 7/1890 | Townsend | 66/27 |
| 2,073,488 | 3/1937 | Lawson et al. | 66/125 R |
| 2,182,295 | 12/1939 | Lebocey | 66/132 R |
| 2,810,279 | 10/1957 | Striar | 66/152 X |
| 3,225,570 | 12/1965 | Mishcon | 66/132 T |
| 4,681,272 | 7/1987 | Brunner et al. | 66/132 R X |
| 4,764,875 | 8/1988 | Carrotte et al. | 66/125 R X |

FOREIGN PATENT DOCUMENTS

| | | | |
|---|---|---|---|
| 2611668 | 10/1976 | Fed. Rep. of Germany | 66/27 |
| 861880 | 5/1956 | United Kingdom | 66/54 |
| 1033827 | 6/1966 | United Kingdom | 66/27 |

*Primary Examiner*—Wm. Carter Reynolds

*Attorney, Agent, or Firm*—Bell, Seltzer, Park & Gibson

[57] ABSTRACT

A control system which allows a plurality of shapes to be knitted by a simple change of profile cam (80). The profile cam (80) controls in a desired variable manner the feed rate of elastic or ground yarns to control the shape of a garment. The shape can also be controlled by further profile cams (200, 202, 204) to control both elastic and ground yarns and in a dial and cylinder circular knitting machine to alter the dial height while the machine is in motion, thereby further controlling the width of a garment.

10 Claims, 6 Drawing Sheets

KNITTING MACHINES

This is a continuation-in-part of application Ser. No. 07/094,338, filed Sept. 8, 1987 now abandoned.

The present invention relates to knitting machines and more particularly to circular knitting machines which are used to knit tubular workpieces.

Circular knitting machines are well known and a common type comprises two main knitting components to produce a tubular workpiece. The components known as a dial and cylinder cooperate together to produce a tubular workpiece, the dial being manually adjustable when the machine is stationary to adjust the stitch length and hence the width of the tubular workpiece within the practical limits set by the size of the machine. The operation of a circular knitting machine is extremely well known within the knitting machine art and does not form part of the present invention. Such operation will be referred to but will not be described in any detail because of its common knowledge within the knitting machine art.

The simple dial and cylinder machine thus produces a parallel tubular workpiece the width of which can be adjusted when the machine is stationary by adjustment of the dial height. The simple machine is, therefore, not capable of producing a shaped tubular workpiece, i.e., one which varies in diameter along its length.

A particular, but not exclusive use of circular type knitting machines is in the manufacture of elastic bandages in which one of the yarns used is elastic, the yarn being knitted or laid in round the circumference of the tube to provide an elasticated bandage.

In a known machine a complex single feed elastic lay-in system is used which directly controls the feed of the elastic yarn. By such control a shaped workpiece, for example to fit a knee, can be produced, the elastic yarn serving to shape the workpiece.

A further known machine is the single cylinder stocking machine which is used to manufacture shaped stockings. This type of machine is provided with a drum/cam control system. The machine can knit a limited graduated shape, e.g. a stocking shape by a combination of the control drum segments and by a graduated lowering of the cylinder during knitting using a rack wheel, cam and chain studs. The machine is, however, relatively non-versatile in that the shape to be knitted is not readily alterable and the machine cannot control the multi-feed of elastic and ground yarns.

The present invention provides a control system for a knitting machine which enables the machine to produce a variable width workpiece of desired shape which control system is versatile in use and which is capable by simple changes of altering the shape produced by the machine.

The present invention, therefore, provides a control system for a circular knitting machine, the control system including means for varying the rate at which yarn is supplied to the machine in a controlled manner over a period of time such that the shape of the workpiece is controlled by the rate of yarn feed.

Preferably in a first embodiment the controlled yarn is a single feed of elastic yarn. In an alternative embodiment the controlled yarn is a ground yarn.

In an alternative embodiment many yarn feeds may be controlled either elastic or non-elastic or ground yarns.

Preferably the means for varying the rate at which yarn is supplied to the machine is by means of a profile cam which is rotated to act in a direct linear manner on a variable speed pulley to control the yarn feed supply rate. In a particular embodiment the rotational speed of the profile cam is varied relative to the main drive speed to produce a different shape of workpiece.

Preferably the variable speed pulley is driven from the main drive supply such that the yarn feed is driven at a variable speed which is a ratio of the main drive speed of the knitting machine.

In a further embodiment in addition to controlling the elastic yarn the ground yarn is controlled at a different rate to the elastic yarn. In a more complex control system for a dial and cylinder machine the dial height may also be adjusted by further adjustment means in addition to the feed yarns during knitting. Thus the width of a workpiece may be adjusted in a variable manner to produce a variable width garment.

The present invention also provides a method of producing a variable width garment on a circular dial and cylinder knitting machine by adjusting the dial height of the machine while the machine is running. Additionally, the feed rate of an elastic yarn may also be adjusted at the same or a different rate to the dial adjustment thereby producing a garment of wide width variation.

Embodiments of the present invention will now be described, by way of example with reference to the accompanying drawings, in which—

Figure 1:
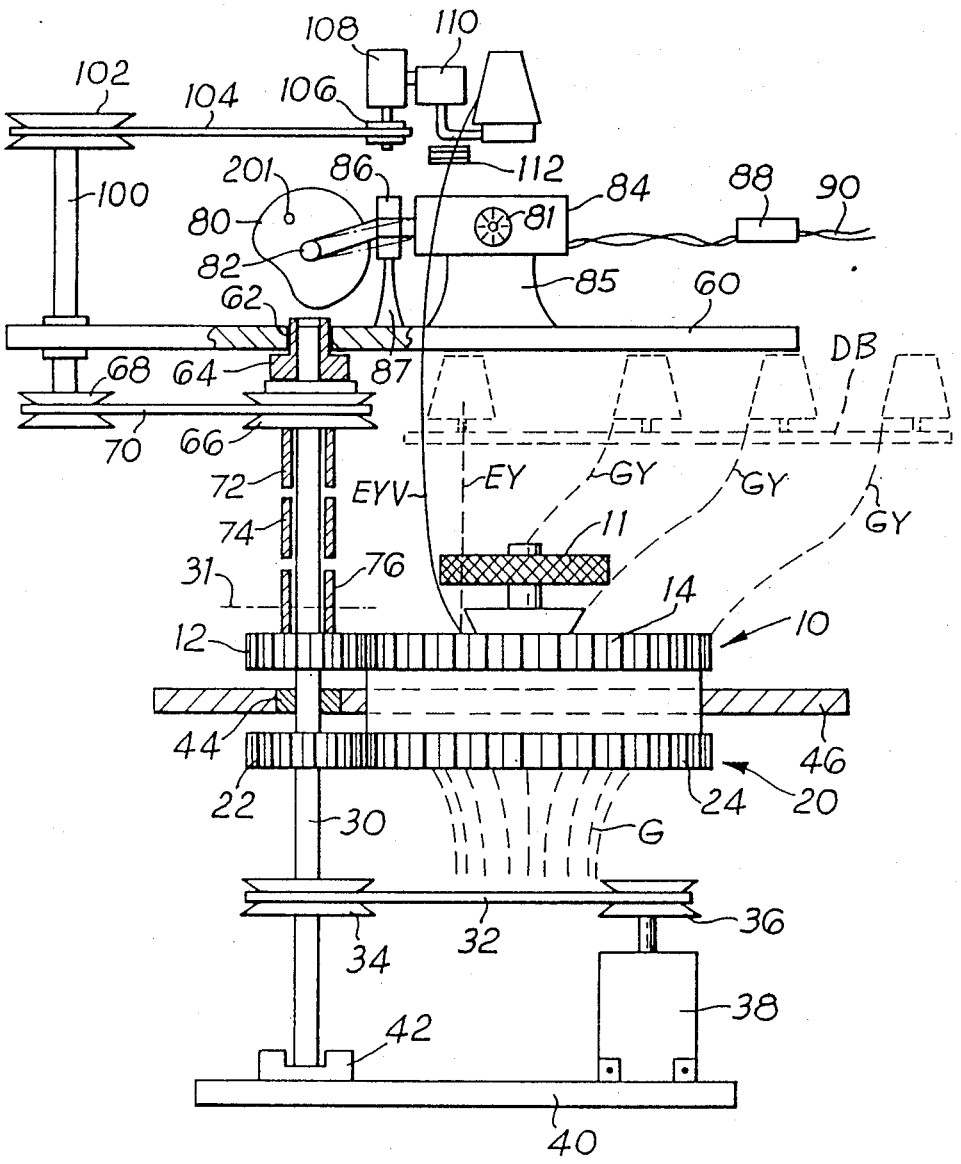
FIG. 1 shows diagrammatically a first control arrangement for a knitting machine according to the present invention.

With reference now to FIG. 1, the control system is shown in conjunction with a dial and cylinder true rib knitting machine but it may be used with other types of knitting machine. Such machines are well known and the knitting portion of the machine will not be described in detail.

The dial portion of the machine is indicated generally at 10 and the cylinder at 20. They are driven, in known manner, by gear trains 12, 14 and 22, 24, respectively, the drive gears 12, 22 being fixed to a main drive shaft 30 driven by a belt and pulley arrangement 32, 34 driven from a pulley 36 mounted on the main drive motor 38 for the knitting machine. The motor 38 is mounted onto a main frame 40 which may form the base of the machine (if bench mounted) or may be fitted with legs (not shown) for free standing operation.

The shaft 30 is journalled at two points 42, 44, the journal 44 being in a plate 46 which supports the dial and cylinder arrangement 10, 20. Plate 46 is mounted in a fixed relation to plate 40 by any convenient means, e.g. welded struts (not shown).

In a normal knitting machine the drive shaft 30 is terminated at a height as shown by dotted line 31 just above gear 12. The dial 10 is adjustable while the machine is stationary by a knurled nut adjuster arrangement 11 which when raised increases the intake per stitch of ground yarn GY. As shown for a typical machine, there are a plurality (e.g. 3) ground yarns and a single elastic yarn feed. In the known knitting machines the dial height determines the yarn required by the machine and the machine pulls the yarn required, the yarn being held in cones on overhead gantries as indicated in dotted outline. As an alternative to allowing the yarn to be pulled by the dial the yarn can be metered to give a required length of yarn particularly in the case of the elastic yarn EY by a driven belt arrangement DB for the cone spools. This is well known and will not, therefore, be described in further detail.

In the control arrangement of the present invention in FIG. 1 means is provided for adjusting the feed rate of the elastic yarn EY which is now shown as a continuous line EYV.

The arrangement is as follows. The shaft 30 is extended in an upward direction and is journalled in a bearing 62 in an upper plate 60. Bearing 62 is surrounded by a sliding collar 64 which is free to move vertically on extended shaft 30. (It is noted here that the arrangement shown is diagrammatic for explanation only.) The collar 64 can be forced to bear down in a direct linear manner onto a variable speed drive pulley 66, fixed on the shaft 30, and which (in well-known fashion) cooperates with a mating pulley 68 via belt 70 such that on pressure being applied to pulley 66 the belt 70 is adjusted and forces a change in the position of pulley 68 thereby speeding up the rotation of pulley 68. The downward movement of pulley 66 is resisted by filling the shaft distance between pulley 66 and gear 12 with collars 72, 74, 76. Downward pressure on collar 64 is achieved in a direct linear manner by a profile cam 80 (preferably made from steel plate of, for example ⅜" to ½" thick) which is rotatably mounted on a shaft 82 driven by an electric motor 84 via a gearbox 86. Motor 84 and gearbox 86 are rigidly mounted onto top plate 60 by supports 85, 87. The shaft 82 can be driven at a relatively slow speed by gearbox 86 and hence the profile cam 80 turns slowly. The speed of rotation of profile cam 80 can be further changed by using a variable speed motor 84 controlled, for example, by an electronic controller 88 connected in the main electrical feed line 90.

Thus, by virtue of the profile cam 80 rotating and providing a variable pressure on pulley 66 the speed of rotation of pulley 68 is affected. Pulley 68 is keyed onto a shaft 100 onto which a further preset ratio capstan drive 102, 104, 106 is connected to drive via pulley 106 a yarn feed control system 108, 110, 112. The capstan 102 and associated pulley 106 are adjustable when the machine is stationary to set up the width of the workpiece by defining a fixed feed speed for the yarns controlled by the capstan. The variability of the yarn feed is then controlled (within the range set by the preset capstan) by the profile cam 80. Thus, before knitting is commenced the capstan is manually set to give the minimum width while the profile is also positioned at its minimum width position. The arrangement is such that via gearbox 108, and direction change device 110, the "constant" feed device 112 can be controlled to feed the elastic yarn EYV at a rate determined by the rotational speed of pulley 106. Since pulley 106 is controlled effectively by the rotation of profile cam 80 then it may be seen that the shape of the garment G knitted by the machine can be controlled by the shape of profile cam 80 and by the speed of rotation of profile cam 80 relative to the operating speed of the machine as controlled by motor 38.

If it is assured (as normally) that motor 38 is a constant speed drive then the length of a profiled garment G will be controlled by the speed of rotations of profile cam 80 and the width variation will be controlled by the profile shape. The working limits being set by adjusting the capstan 102.

The embodiment shown in FIG. 1 is able only to control one type of yarn feed, although by a simple toothed belt arrangement for belt 104 it may easily be seen that more than one elastic yarn feed may be controlled. Additionally, one or more of the ground feed yarn or non-elastic yarns may be controlled in a variable manner as a fixed ratio of the variable elastic yarn feed.

Figure 2:
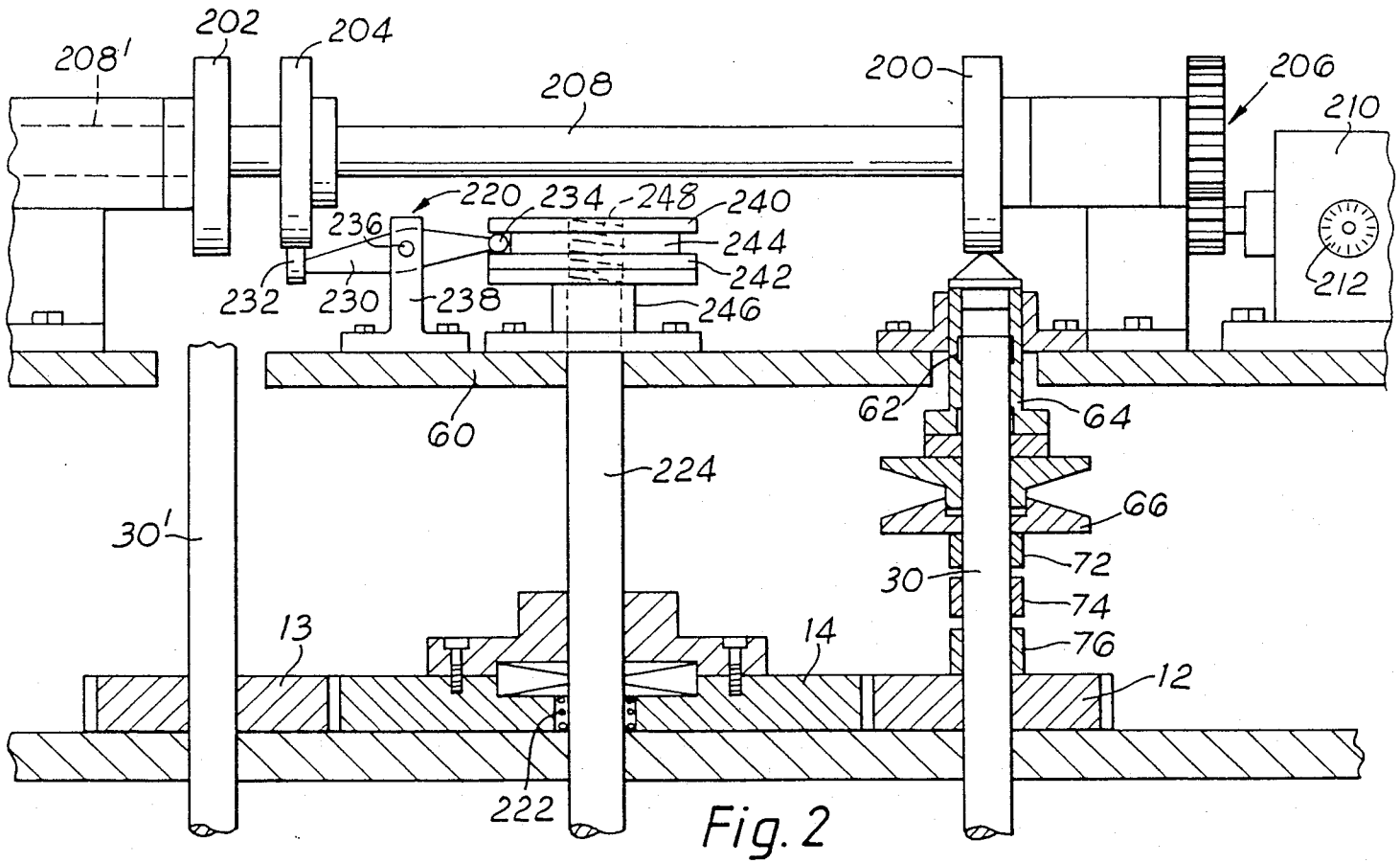
FIG. 2 shows diagrammatically in side elevation a second control arrangement for a knitting machine according to the present invention.

The arrangement shown in FIG. 2 provides for all three main criteria to be controlled, elastic yarn, ground yarn and dial height, by three separate profile cams or contours, respectively 200, 202 and 204. The contours are driven from a gearbox and shaft arrangement 206, 208 driven by a variable speed motor 210 with dial speed adjuster 212. (A separate drive could be used for each profile 200, 202, 204, if desired.)

As described for FIG. 1, the profile cam 200 acts on the variable speed drive pulley 66 via collar 64 and as shaft 208 is rotated the speed of elastic yarn feed controlled via the arrangement shown in FIG. 1 is varied as the machine knits.

In FIG. 2, for clarity and simplicity, the main knitting mechanism is not shown nor is the yarn feed. Where possible for parts which perform the same or similar functions as in FIG. 1, the same reference numerals are used. Thus, the pressure applied by the contour 200 is resisted by collars 72, 74, 76 and this causes the pulley 66 to close up, thereby speeding up the supply of elastic yarn. Similarly, when the contour becomes convex thereby relaxing pressure on pulley 66, the supply of elastic yarn is slowed down.

In FIG. 2 the dial and its main gear is shown to the left of the main drive gear 12. A further gear 13 is entrained with gear 14 and is thereby driven at the same speed as gear 12. A further shaft 30' is mounted to rotate with gear 13 and a further variable speed pulley, not shown but similar to pulley 66, is mounted on the upper end of shaft 30' to cooperate with profile cam 202. Thus, by means of a further variable speed pulley the ground yarn supply can be controlled. If it is not required to vary the feeding speed of the ground yarn relative to the elastic yarn but to keep it constant, then the ground yarn can be fed by suitable attachments to the other end 208' of shaft 208.

The operation of the profile cam or contour 204 will now be described.

As the contour 204 rotates, it depresses or releases the see-saw arrangement 220 which is spring urged by a compression spring 222 in the dial mechanism to maintain a shaft 224 in a downwardly direction. Shaft 224 is an extension of the shaft through the center of the dial mechanism and raising or lowering shaft 224 thereby adjusts the dial height (and hence the garment size) in the same manner as knurled nut 11 in FIG. 1.

See-saw 200 comprises a centrally pivoted lever 230 provided with roller bearings 232, 234, to prevent excessive friction, at either end. The lever 230 is pivoted at 236 in an upstanding fork 238 mounted on plate 60. The roller bearing 234 is sandwiched between two plates 240, 242 mounted in a spaced-apart manner on shaft 224 by spacing member 244, shaft 224 being provided with an upper bearing 246. Thus, as contour 204 rotates so, in conformity with the contour, the dial height of the machine is altered, thereby altering the width of the knitted garment.

Initial height can be set by adjusting the position of components 240, 242, 244 on shaft 224 by screw thread 248.

Figure 3:
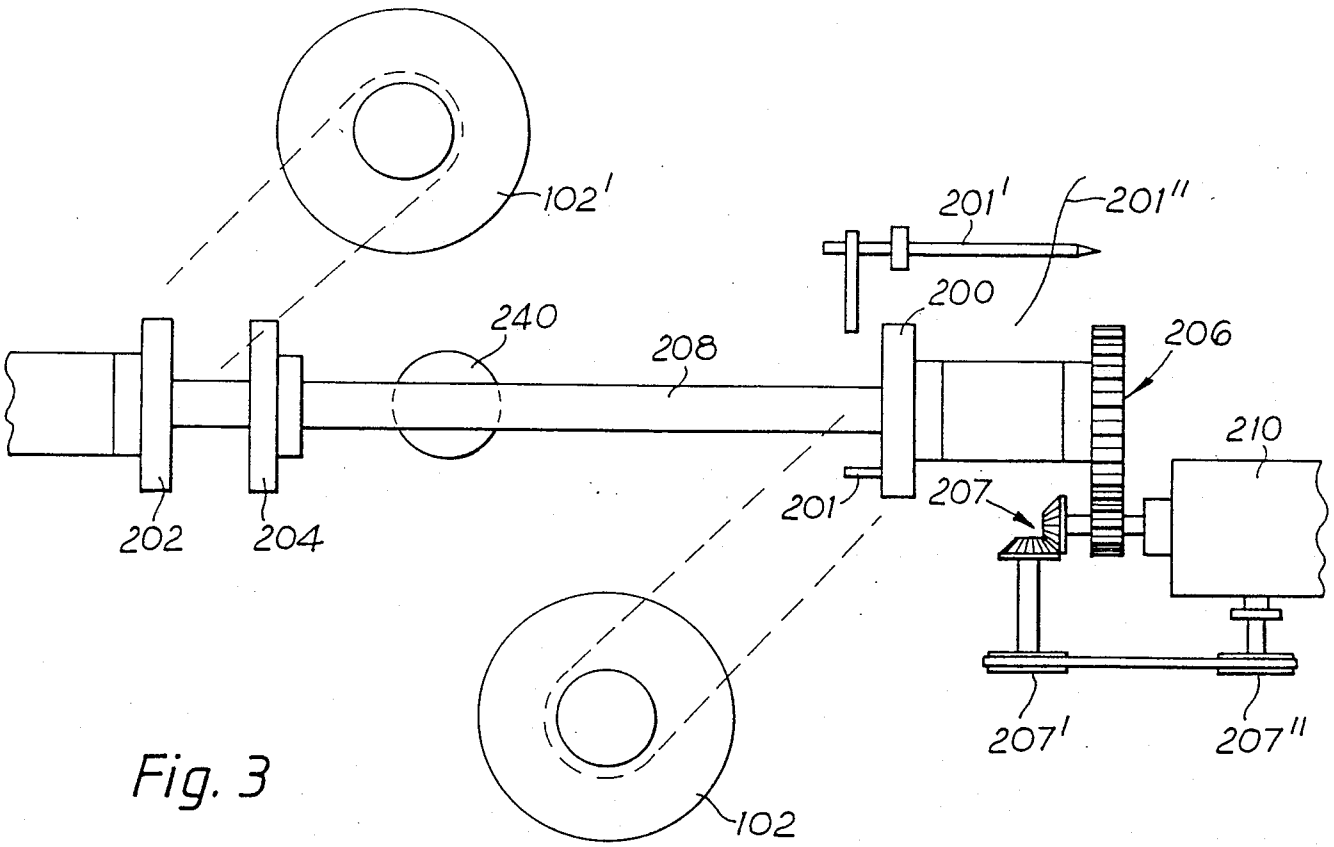
FIG. 3 shows the control arrangement of FIG. 2 in plan view.
Figure 4:
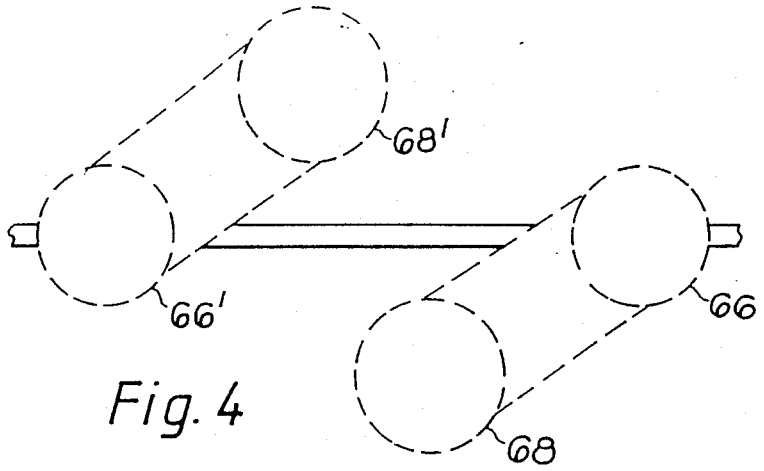
FIG. 4 shows a variable drive layout for the control system of FIG. 2.

With reference now to FIG. 3, the arrangement of FIG. 2 can be shown in diagrammatic plan view and in FIG. 4 the capstans 102 and 102' which respectively control the feed speeds of the elastic and the ground yarn can be seen. Capstan 102 is preset and then its speed is controlled, as described with reference to FIG. 1, and capstan 102' is controlled by profile cam 202 in a similar manner. (In FIG. 4 the dial height control is omitted for clarity.) Pulley 68 and capstan 102 thereby control the speed of feed of the elastic yarn and a similar pulley 68' via a capstan 102' the speed of feed of the ground yarn.

Profile cams 80 (FIG. 1) and 200, 202, 204 are readily replaced, being held on their respective shafts by, for example, set screws. The profile cams are thereby also readily positioned with respect to each other so that a garment is correctly fashioned.

Garments may, therefore, be produced in an enormous variety of ways. In FIG. 1, if the motor 84 is switched off the knitting machine will produce parallel tubular fabric at a width determined by the position of profile cam 80. With the motor 84 rotating at high speed the machine will produce variable width fabric with the "pattern" produced by profile cam 80 being repeated over short lengths. With motor 84 rotating at slow speed the pattern length will be longer.

With the arrangement shown in FIGS. 2 to 4, the shape of the garment can be influenced by the shape of all of the three profile cams and by the speed at which they are rotated.

Figure 5:
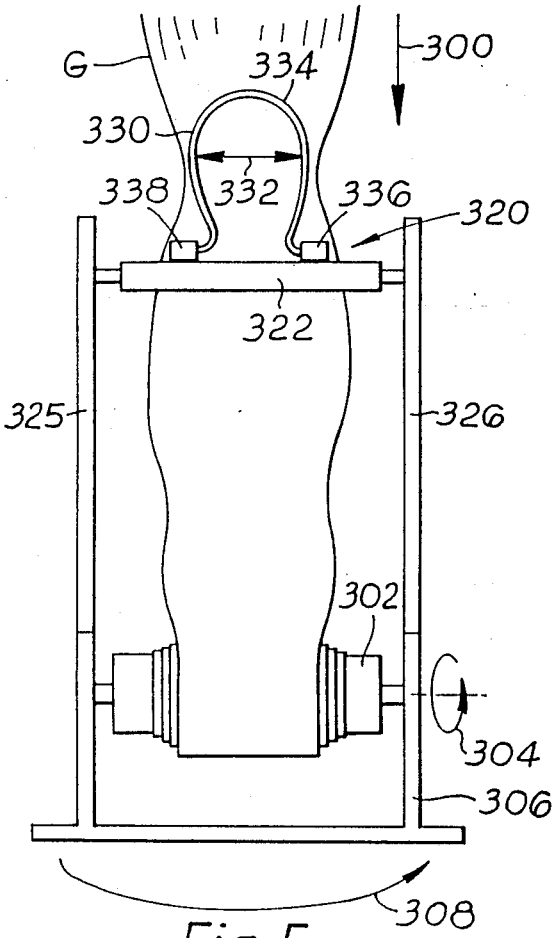
FIG. 5 shows diagrammatically in front elevation a garment collection arrangement for a circular knitting machine.
Figure 6:
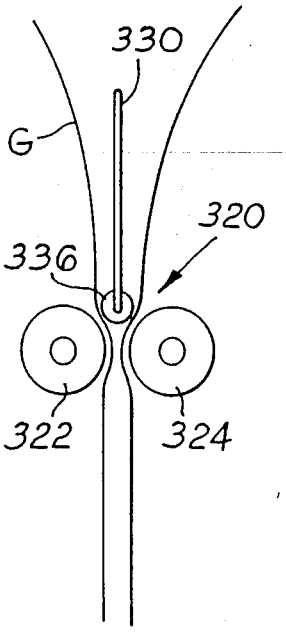
FIG. 6 shows the garment collection arrangement of FIG. 5 in side elevation.

With reference now to FIGS. 5 and 6, the manufacture of complex shapes produces a problem in ensuring that they are correctly folded for subsequent processing. (Here it should be explained that in circular knitting machines, or indeed other types of knitting machines, garments are produced continuously and are subsequently separated in a finishing process. This is normal practice and, therefore, will not be described further.)

For circular knitting machines the knitted garment "emerges" from the cylinder in a rotational manner because of the method of knitting. The arrangement shown in FIG. 5 rolls up the garment and additionally ensures that it is not creased when rolled.

The garment G is knitted in a direction shown by arrow 300. The garment G is wound on a roller 302, the roller rotating in the direction shown by arrow 304 (by means not shown). The roller 302 is journalled in a frame 306 which is rotated in a horizontal plane in a direction shown by arrow 308 to thereby complement the rotation of the garment G as it is knitted.

With parallel tubular garments there is little problem in rolling them up as they are all the same width (even though they may subsequently be cut into shorter lengths).

With the control system according to the present invention, garments of considerable width variation can be produced and this, therefore, creates problems in rolling them. In FIGS. 5 and 6, there is shown a second collection roller means generally indicated at 320 which comprises two non-driven rollers 322, 324. These rollers are rotatably mounted in bearings on extended leg portions 326, 328 of frame 306. The rollers 322, 324 are mounted as shown in FIG. 6 only a short distance apart and the garment G passes between the rollers. On commencement of the knitting action an elongate portion of a garment G is knitted (or several garments if short), and this is threaded through rollers 322, 324 and affixed to roller 302 for subsequent take up. Prior to threading through rollers 322, 324 an omega shaped expanding element 330 is inserted as shown inside the garment. The element 330 can expand freely in the direction of arrow 332 and, therefore, maintains the garment G in a flat condition through rollers 322, 324 and hence onto roller 302.

Element 330 may be constructed, as shown with a length of flexible plastic piping 334, with suitable end pieces 336, 338 which serve to prevent the piping 334 from being drawn through the rollers.

The control system allows the production of various shaped garments in one piece.

Figure 7:
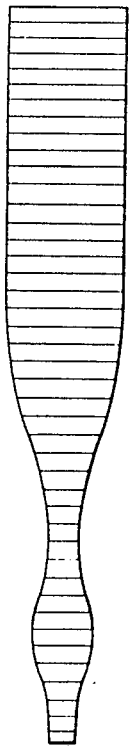
FIGS. 7 to 11 show garments producible on a knitting machine using a control arrangement according to the present invention.

FIG. 7 shows a graduated compression bandage shaped to conform to a male or female leg. All yarns may be controlled, the circular bandage, therefore, having the natural shape as shown. The bandage can be made to exert any desired pressure throughout the leg length by appropriate control.

At present such bandages are made in parallel fabric and, therefore, do not exert a graduated pressure on the leg, but either generally exert too much or too little pressure on the leg at different positions. The present invention (see FIG. 2) makes it possible to graduate all yarns and to be able to multi-feed the elastic yarn to make a ratio of one ground yarn to one elastic yarn or any other desired ratio. The presently used ratio of one elastic yarn to four ground yarns produces a helical marking on a leg when the bandage is removed showing clearly the poor pressure pattern, whereas a bandage made in accordance with the present invention will produce even pressure and at a controlled level. This is extremely important, for example, in the treatment of Deep Vein Thrombosis.

Figure 8:
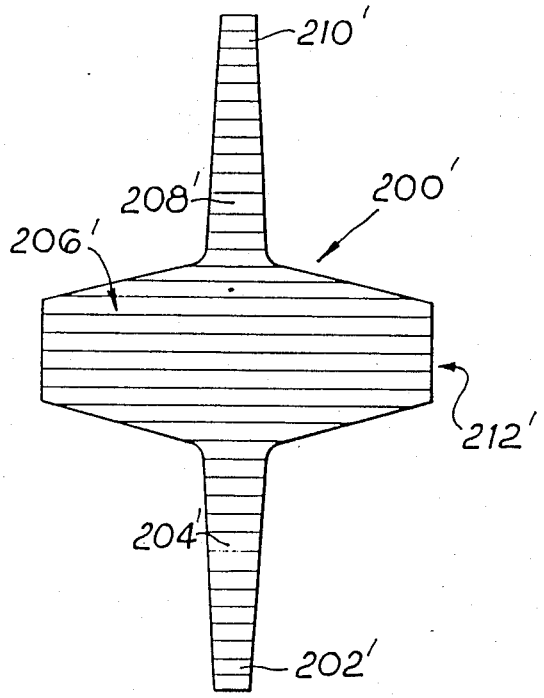

FIG. 8 shows a pullover or sweater 200' made in one piece in a "sideways on" manner. The sweater 200' is commenced at one arm end 202' where the machine can be made (by adjustment of the dial height) to knit a small diameter garment and by successive alterations of dial height and yarn feed, as described with reference to FIG. 2, the width of the garment can be altered to the arms 204' wide body 206' and then reduced again to form the second arm 208' and cuff 210'. Elastic yarn can be used if required on, for example, the arms. The neck 212' of the sweater can be formed to a desired shape by cutting the tube and suitably finishing in known manner.

Figure 9:
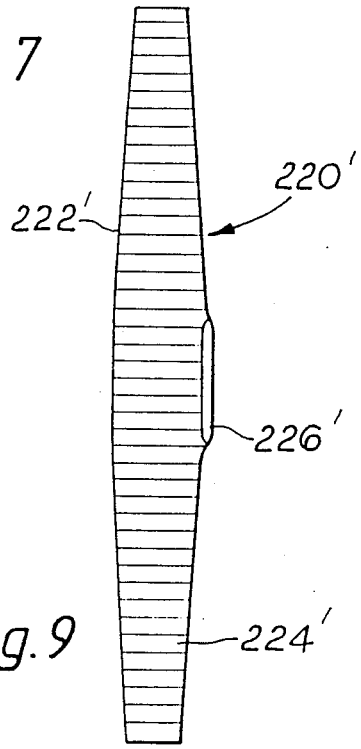
Figure 10:
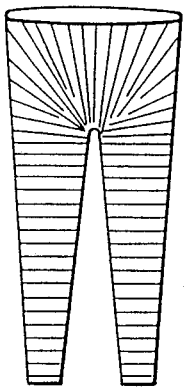

FIGS. 9 and 10 show a pair of long pants (commonly known as "long johns") 220'. They are made, as shown in FIG. 9, in one long piece with legs 222', 224' and then a cut 226' is made for the upper opening. They are then bent to shape.

The garments in FIGS. 7 to 10 are, of course, made continuously so that a finishing process will also be required at each end (e.g. 202', 210' in FIG. 8), but this finishing process can be simple and is well known in the trade.

Though a true rib can be attached during a finishing process, it is possible to provide a "mock rib" by changing the dial height to provide a reduced stitch and by slowing down the rotation of the profile cam (or stopping it) to give a parallel fabric.

Figure 11:
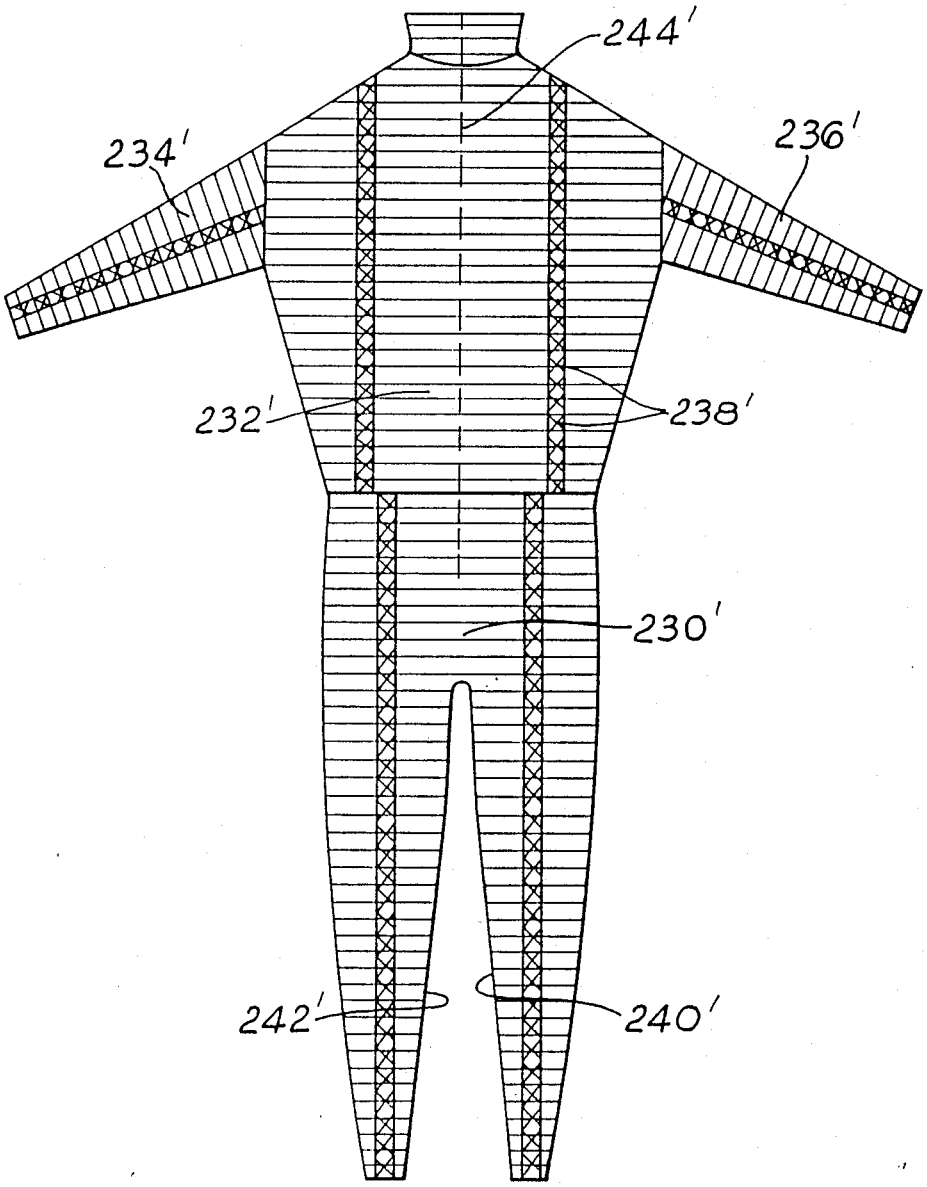

FIG. 11 shows the type of finished garment that can be readily produced and shows a track suit made in four pieces, trousers 230', body 232' and arms 234', 236'.

Air vents 238' may be provided at any points in the pieces as shown.

The garment may be made with elastic yarn to give a desired degree of stretch and the degree of stretch may be readily varied to give desired pressures, for example on the calf muscles to assist, for example, in a racing driver in blood flow to the head. It may be seen that such a suit could be designed to assist in medical conditions such as varicose veins or torn muscles while providing attractive clothing because it can be made multicolored and styled as required. The garment can be made as a two-piece by suitable cutting and joining (e.g. in inside legs 240', 242' in a one-piece with a zipper 244' (shown dotted)).

Thus, the machine, by being able to vary dial height and yarn feed and by being provided with a link between dial height and the speed of feed device 112 (FIG. 1), can be made to knit extremely wide widths and close or open knit garments thereby producing cuffs, polo necks and bodies of garments all on one machine. Obviously, there is a maximum size limit for each size of machine, but using elastic yarn feed the variation in width is considerable. Without elastic yarn feed the variation is less but is still useful in producing shaped garments.

By suitable gearing the position of the profile cam (which can control (see FIG. 2) the elastic yarn feed, ground yarn feed and dial height) can be used to control the speed of the profile drive motor 210. This is shown in FIG. 3 wherein a further bevel gear arrangement 207 may be provided to drive a pulley and belt arrangement 207', 207" and pulley 207" may be used to move a dial speed controller 212 on motor 210. By selection of the gear ratios in arrangement 207 or by the relative size of pulleys 207', 207", the rate of change of motor speed with profile cam rotation can be adjusted. Thus, very complex shapes can be produced from one profile.

It may be seen that other mechanical linkages between profile cam position and motor speed control can be used or an electronic control using, for example, a potentiometer could be used. It is also possible to control the speed of, for example, motor 84 by a simple computer program or paper tape to give varying lengths and/or widths of garments. If independent motors for control of elastic yarn feed, ground yarn feed and dial height are used, then each can be controlled from a single program, specifying, for example, voltages for speed control of each motor over periods of time, to produce a variety of sizes of garment all of similar shape. Such programs for the control of motors in paper tape form and the apparatus for effecting control of electric motors are well known and are, therefore, not described in any further detail.

In a preferred embodiment the profile cam may be provided (see FIGS. 1 and 3) with a pin 201 which signifies the start (or finish) position of a garment. This pin can be used to, for example, count the number of garments produced or it can be used to move a felt tip pen 201' which may be mounted in a spring loaded manner to strike the feed yarn 201" and thereby produce a mark (of suitable distinctive color) on the garment to accurately identify the cutting position between garments. Thus, the finishing operator can quickly and accurately separate the garments or this could be done automatically by a machine with suitable optical recognition equipment.

The process is also particularly useful for production of garments such as leotards or swimsuits in which the ground yarn may be, for example, a lycra type giving the swimwear two-way stretch. Various styles and shapes can be made by simple alteration of the profiles controlling the feeds.

That which is claimed is:

1. A control system for a circular knitting machine the control system including a main drive shaft, and means for varying the rate at which yarn is supplied to the machine in a controlled manner over a period of time such that the shape of the workpiece is controlled by the rate of yarn feed, said means for varying the rate at which yarn is supplied to the machine including a rotatable profile cam, and a variable speed pulley fixed on said main drive shaft for rotation therewith, and wherein said rotatable profile cam acts in a direct linear manner upon said variable speed pulley to control the yarn feed supply rate.

2. A control system for a circular knitting machine as claimed in claim 1 in which the controlled yarn is a single feed of elastic yarn.

3. A control system for a circular knitting machine as claimed in claim 1 in which the controlled yarn is a ground yarn.

4. A control system for a circular knitting machine as claimed in claim 1 in which a plurality of yarn feeds are controlled either elastic or non-elastic/ground yarns.

5. A control system for a circular knitting machine as claimed in claim 1 including an electric motor drivingly connected to said rotatable profile cam, and an electronic control system to supply control signals to said electric motor to control the yarn feed supply rate.

6. A control system for a circular knitting machine as claimed in claim 1 in which the rotational speed of said profile cam is varied relative to the main drive speed to produce a different shape of workpiece.

7. A control system for a circular knitting machine as claimed in claim 1 in which said variable speed pulley is driven from said main drive shaft such that the yarn feed is driven at a variable speed which is a ratio of the main drive speed of the knitting machine.

8. A control system for a circular knitting machine as claimed in claim 1 in which the knitting machine is of the dial and cylinder type and in which a control system is provided for the dial and cylinder machine and includes means for adjusting the dial height by further adjustment means in addition to the feed yarns.

9. A control system for a circular knitting machine as claimed in claim 1 including means for collecting the completed workpieces, said means comprising rotary collection roller means rotating at the speed of rotation of the dial and cylinder.

10. A control system for a circular knitting machine as claimed in claim 9 including means for marking the beginning of each workpiece produced.

* * * * *